US007029324B2

(12) United States Patent
Annequin

(10) Patent No.: US 7,029,324 B2
(45) Date of Patent: Apr. 18, 2006

(54) COAXIAL ELECTRICAL CONNECTOR ELEMENT

(75) Inventor: Sébastien Annequin, Saint Laurent du Pont (FR)

(73) Assignee: Radiall, Rosny-Sous-Bois (FR)

( * ) Notice: Subject to any disclaimer, the term of this patent is extended or adjusted under 35 U.S.C. 154(b) by 0 days.

(21) Appl. No.: 10/124,631

(22) Filed: Apr. 17, 2002

(65) Prior Publication Data

US 2002/0164901 A1 Nov. 7, 2002

(30) Foreign Application Priority Data

May 4, 2001 (FR) ..... 01 06008

(51) Int. Cl.
*H01R 9/05* (2006.01)

(52) U.S. Cl. ..... 439/579

(58) Field of Classification Search ..... 439/68, 439/579, 79; 361/780
See application file for complete search history.

(56) References Cited

U.S. PATENT DOCUMENTS 3,676,746 A * 7/1972 Kassabgi et al. ..... 439/79
3,689,865 A * 9/1972 Pierini et al. ..... 439/60
4,573,104 A 2/1986 Kamada ..... 361/399
4,827,378 A * 5/1989 Gillan et al. ..... 361/424
4,964,806 A 10/1990 Sakamoto et al. ..... 439/79
5,194,010 A * 3/1993 Dambach et al. ..... 439/79
5,292,256 A * 3/1994 Brunker et al. ..... 439/108
5,853,295 A 12/1998 Rosenberger ..... 439/63
6,319,016 B1 * 11/2001 Juntwait ..... 439/579

FOREIGN PATENT DOCUMENTS

EP 0 552 622 A1 7/1993
EP 0 911 912 A2 4/1999

* cited by examiner

*Primary Examiner*—Briggitte R. Hammond
(74) *Attorney, Agent, or Firm*—Schweitzer Cornman Gross & Bondell LLP

(57) ABSTRACT

The present invention relates to a coaxial electrical connector element for providing electrical connection between at least one contact element and a main printed circuit card, each contact element(s) comprising a central conductor and an outer conductor, the connector element comprising a support element suitable for receiving the contact element(s) and an intermediate printed circuit card carrying conductor tracks enabling the central conductor(s) to be connected electrically to conductor tracks of the main printed circuit card. In the connector element, the intermediate printed circuit card has an end face presenting at least one projecting portion, one of the conductor tracks of the intermediate printed circuit card extending over said projecting portion and coming into contact with a conductor track of the main printed circuit card.

29 Claims, 3 Drawing Sheets

COAXIAL ELECTRICAL CONNECTOR ELEMENT

The present invention relates to a coaxial electrical connector element for providing electrical connection between at least one contact element and a main printed circuit card, said connector element including an intermediate printed circuit card.

BACKGROUND OF THE INVENTION

British patent application No. GB 2 169 157 discloses an electrical connector enabling connections to be made to a plurality of conductors on a main printed circuit card. The connector comprises a secondary printed circuit card carrying conductor tracks, said secondary card being fixed to the main card by means of conductive tabs. Such a known connector presents drawbacks, in particular because the conductive tabs can be subjected to mechanical stress and become deformed, thereby damaging the connector.

OBJECTS AND SUMMARY OF THE INVENTION

There exists a need to improve the reliability of a coaxial electrical connector element, in particular concerning mechanical retention thereof on a printed circuit card.

The invention provides a novel coaxial electrical connector element for providing electrical connection between at least one contact element and a main printed circuit card, each contact element(s) comprising a central conductor and an outer conductor, the connector element comprising a support element suitable for receiving the contact element(s) and an intermediate printed circuit card carrying conductor tracks enabling the central conductor(s) to be connected electrically to conductor tracks of the main printed circuit card, wherein the intermediate printed circuit card has an end face presenting at least one projecting portion, one of the conductor tracks of the intermediate printed circuit card extending over said projecting portion and coming into contact with a conductor track of the main printed circuit card.

By means of the invention, the connector element is held to the main printed circuit card without using fixing tabs, the fixing tabs being replaced by the projecting portions that are made directly on an end face of the intermediate printed circuit card.

This improves the reliability of the mechanical strength of the connector element when installed on the main printed circuit card.

In addition, the cost price of such a connector element can be reduced since the number of component parts in the connector element can be reduced, since it does not have any fixing tabs, in particular.

The intermediate printed circuit card can be rigid, i.e. not bendable in normal operation.

Preferably, the said intermediate printed circuit card presents orifices each enabling a central conductor of a contact element to be received, each orifice being connected to a conductor track of said intermediate card.

Advantageously, the dimensions of the orifices are selected in such a manner that a central conductor can be inserted as a force-fit in a corresponding orifice.

This adjustment is particularly important since it enables the various portions of the connector element to be soldered simultaneously.

Advantageously, the dimensions of the orifices are selected in such a manner that a central conductor can be inserted as a force-fit in a corresponding orifice.

This makes it possible to avoid performing soldering operations or using separate fitted elements such as bushings in order to make contact between the central conductors and the intermediate card.

In a preferred embodiment of the invention, the above-mentioned end face carries a plurality of projecting portions formed by projections that are preferably placed regularly along said end face, having end faces that are substantially coplanar.

The support element preferably comprises a box presenting housings each suitable for receiving a respective contact element.

The box may have a first face and a second face, the first face being for receiving the intermediate printed circuit card and the second face preferably including openings enabling the contact element to be inserted in said housings.

In an embodiment of the invention, after assembly, the intermediate printed circuit card extends perpendicularly to the main printed circuit card.

The above-mentioned first face may present peripheral portions projecting from a main plane of said first face, the intermediate printed circuit card being suitable for coming to bear thereagainst.

In a particular embodiment of the invention, the box is generally in the form of a rectangular parallelepiped, preferably having portions in relief on a bottom face suitable for bearing against the main printed circuit card, in particular for the purpose of being soldered thereto.

The intermediate printed circuit card and the support element can include portions in relief suitable for co-operating mutually.

Preferably, these portions in relief can also serve to connect the intermediate card electrically to the support element.

The support element advantageously includes at least one deformable tab suitable for holding the intermediate printed circuit card and for making electrical contact with a ground plane thereof.

When the support element comprises a box having a substantially square first face for receiving the intermediate printed circuit card, the box advantageously has two deformable tabs disposed substantially in the middles of two parallel edges of said first face.

The intermediate printed circuit card can include side notches leaving a space between them suitable for receiving the above-mentioned tabs, at least in part.

Advantageously, the support element is conductive, is connected to ground, and is made in particular of a molded zinc alloy or of a metallized plastics material.

Advantageously, the intermediate printed circuit card presents two faces, a first face carrying conductor tracks and a second face presenting a conductive metallized surface over a major portion thereof, which surface is suitable for defining a ground plane and is optionally coated in varnish, the ground plane preferably being connected to the conductive support element.

In a particular embodiment, the ground plane of the intermediate printed circuit card is connected to the support element via said deformable tabs. This improves electromagnetic shielding.

The intermediate printed circuit card may be formed by a substrate made of glass epoxy, for example.

BRIEF DESCRIPTION OF THE DRAWINGS

Other characteristics and advantages of the present invention will appear on reading the following detailed description of a non-limiting embodiment and on examining the accompanying drawings, in which.

MORE DETAILED DESCRIPTION

Figure 1:
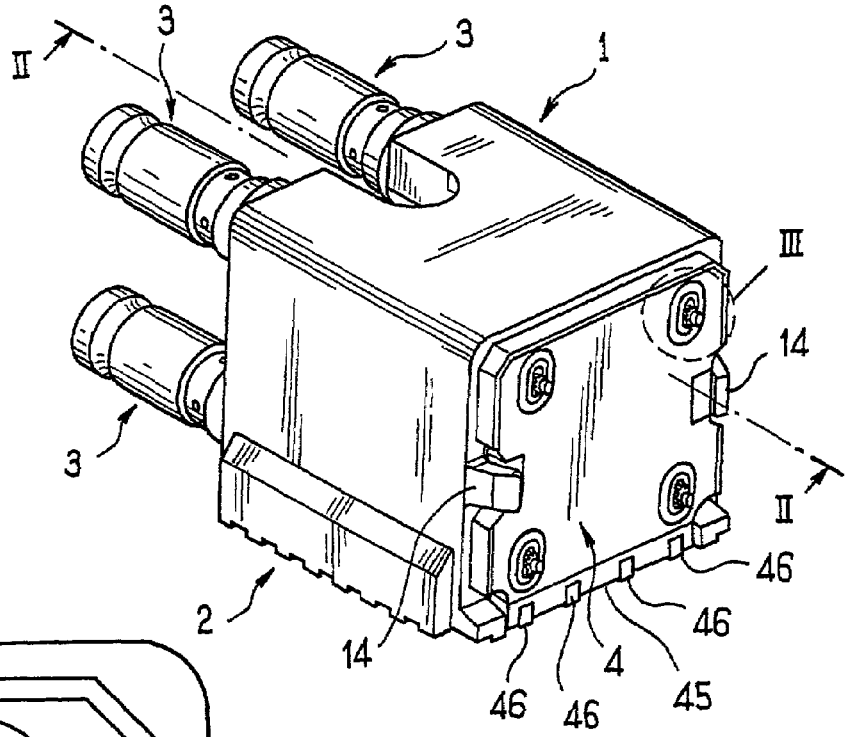
FIG. 1 is a diagrammatic perspective view of a connector element in accordance with the invention.

FIG. 1 shows a connector element in accordance with the invention for connecting four contact elements 3 to conductor tracks of a main printed circuit card (not shown) via an intermediate printed circuit card 4.

The intermediate card is fixed on a support element 2 constituted in the example described by a box.

Figure 4:
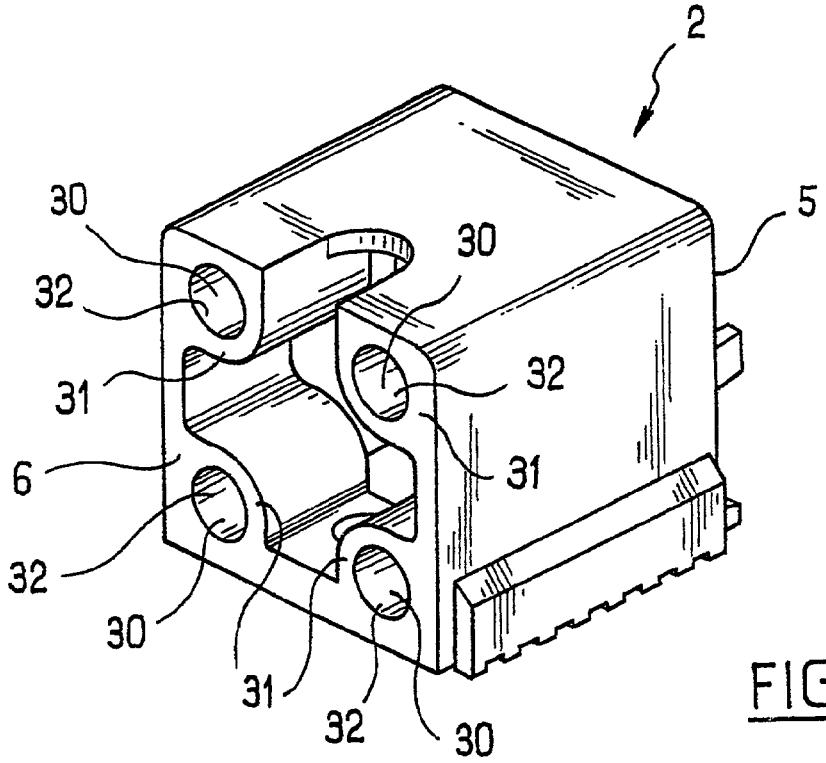
FIG. 4 shows on its own, a box of the connector element of FIG. 1, in diagrammatic manner, seen in perspective from above.
Figure 5:
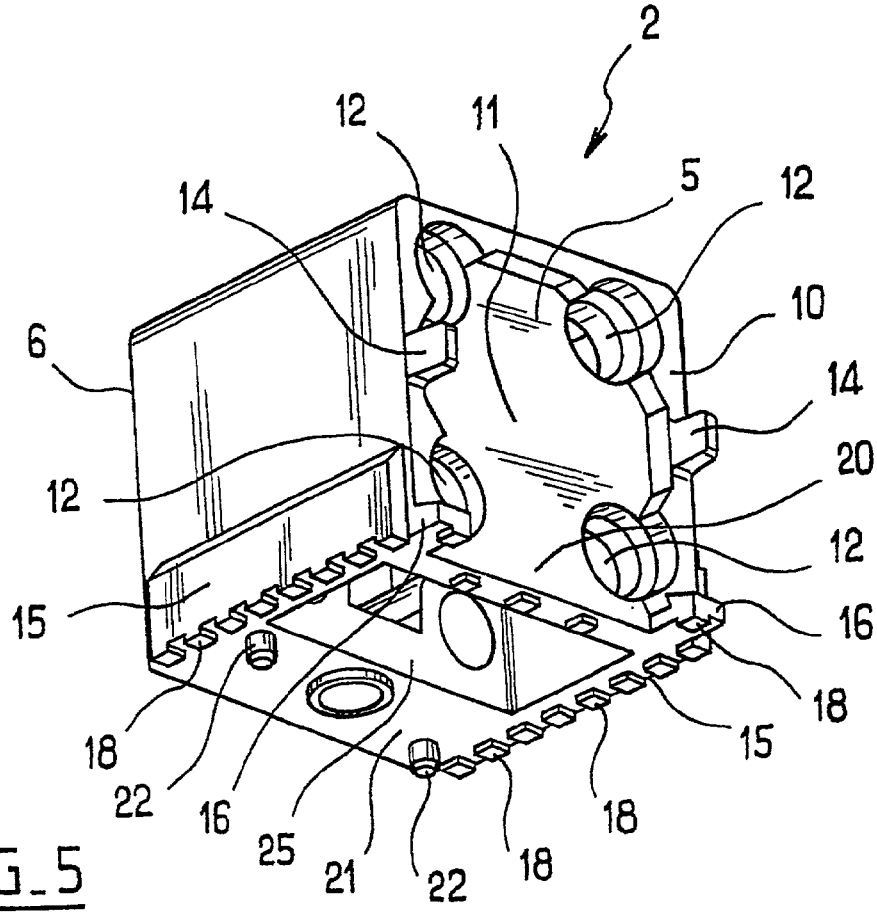
FIG. 5 is a view analogous to FIG. 4, but seen from below.

The box 2 has a body that is generally in the shape of a cube, as can be seen in FIGS. 4 and 5 in particular, the cube having a front face 5 and a back face 6.

The substantially square front face 5 presents a bearing surface 10 along its top edge and its two adjacent side edges, the bearing surface projecting from plane surface 11.

The bearing surface 10 is for receiving the intermediate printed circuit card.

The plane surface 11 is pierced by four circular orifices 12 each situated close to one of the corners of the front face 5.

The front face 5 has two deformable tabs 14 extending from the bearing surface 10, these two tabs 14 being placed in register with each other and each being substantially in the middle of one of the side edges of the front face 5.

These tabs 14 are used for fixing the intermediate printed circuit card to the box 2.

The support element 2 also has side and front extensions 15 and 16 whose bottom faces present studs 18 suitable for standing on a face of the main printed circuit card and suitable for being soldered thereto.

Between them, the front extensions 16 leave a space 20 whose function is explained below.

The box 2 has a bottom face 21 with the studs 18 being situated at the periphery thereof, and it presents two pegs 22 enabling the connector element 1 to be positioned on the main printed circuit card.

The bottom face 21 also has an opening 25 of rectangular section.

The box 2 also has four housings 30 each defined in part by a tubular wall 31, the housings 30 leading to the back face 6 via orifices 32.

Figure 2:
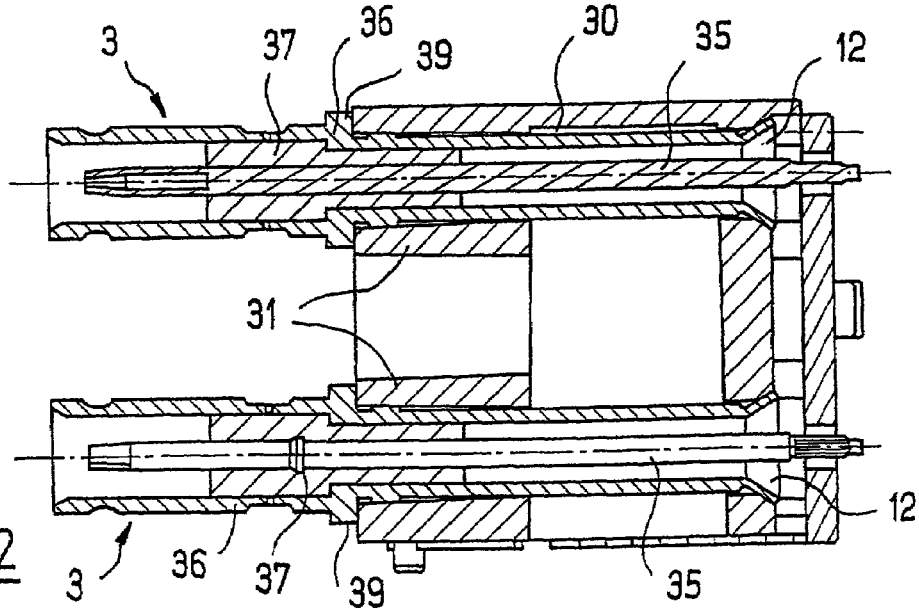
FIG. 2 is a diagrammatic section on II—II showing the connector element of FIG. 1.

As can be seen in particular in FIG. 2, each housing 30 is designed to receive a contact element 3.

Each contact element comprises a central conductor 35 held inside an outer conductor 36 by means of a dielectric element 37.

The outer conductor 36 has a collar 39 that comes to bear against the tubular wall 31 after assembly.

Figure 6:
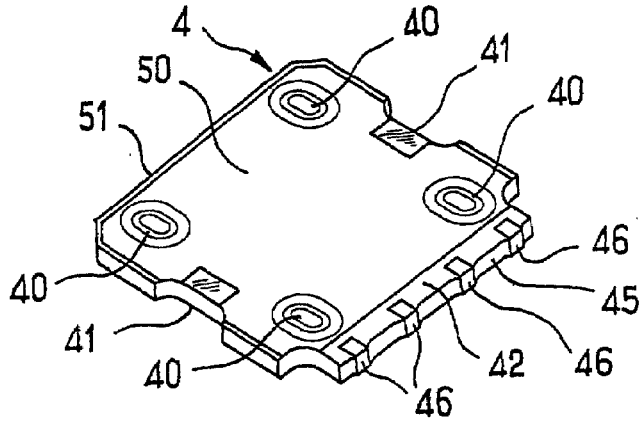
FIG. 6 is a diagrammatic perspective view, showing on its own, an intermediate printed circuit card of the FIG. 1 connector element.
Figure 7:
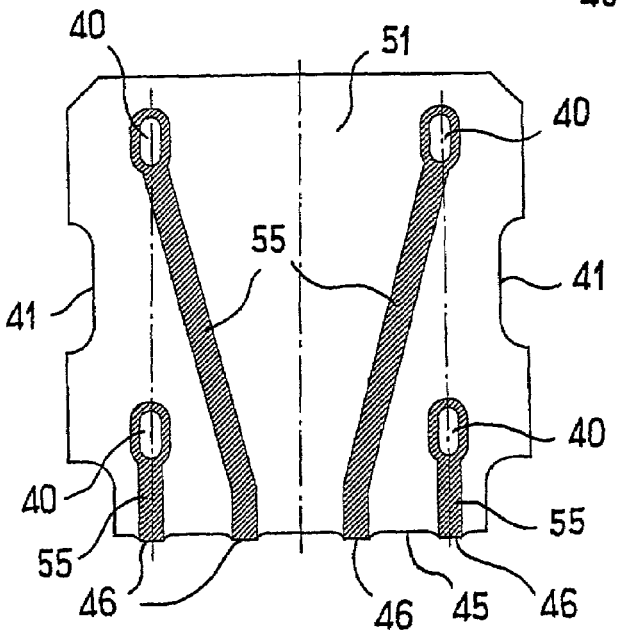
FIGS. 7 and 8 are diagrammatic views of the two faces respectively of the intermediate printed circuit card of FIG. 6.
Figure 8:
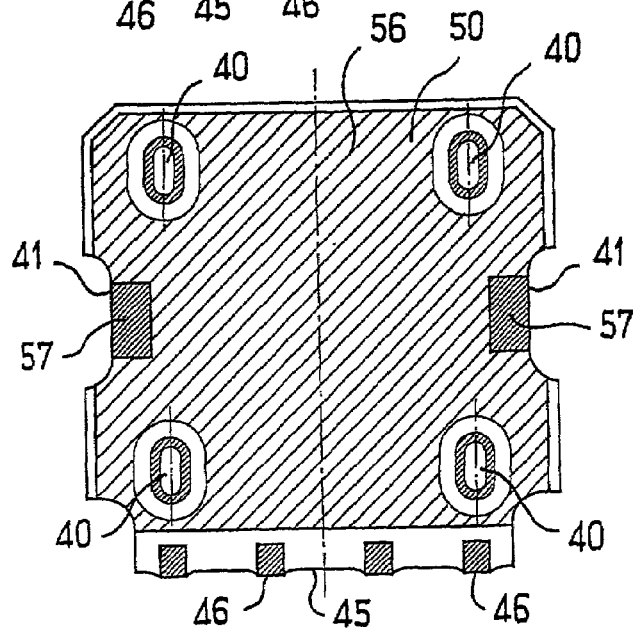

The intermediate printed circuit card 4, shown on its own in FIGS. 6 to 8, is generally square in shape, being pierced by four orifices 40 of oblong section each being designed to receive the end of one of the central conductors 35.

Figure 3:
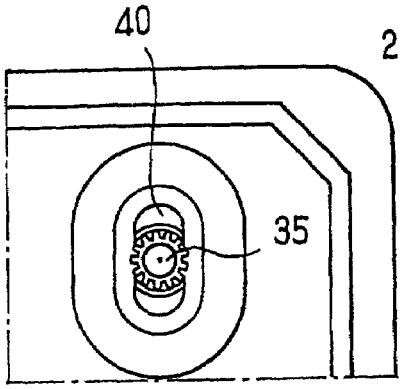
FIG. 3 is an enlarged view of a portion of the FIG. 1 connector element.

The central conductors are arranged in such a manner as to constitute force-fits in the corresponding oblong orifices 40, as can be seen in FIG. 3.

The printed circuit card 4 also has two notches 41 formed in two parallel sides, substantially in the middles thereof, so as to leave a passage for the deformable tabs 14.

The intermediate card 4 presents a portion 42 suitable for engaging in the space 20 between the two front extensions 16.

This portion 42 has an end face 45 presenting four projections 46 that are regularly spaced apart along said face and whose own front faces are substantially coplanar.

The printed circuit card 4 has an outside face 50 and an inside face 51, the inside face 51 looking into the box 2 after the intermediate card 4 has been assembled to the box 2.

As can be seen in FIGS. 7 and 8, the face 51 has four conductor tracks 55 connected to the orifices 40, the tracks extending over the projections 46 and, for a short length, over the outside face 50.

In the example described, the intermediate printed circuit card 4 is constituted by a glass epoxy substrate.

The box 2 is conductive and in the example described it is made of a molded zinc alloy or of a metallized plastics material.

Over substantially its entire surface, the outside face 50 is covered in a metallized layer 56 which in turn is covered in a varnish, this layer being set back from the conductor tracks 55, which tracks are made by metallization.

Two metallized zones 57 that are not covered in varnish are provided in the vicinity of the notches 41 so as to provide an electrical connection between the surface 56 and the tabs 14 of the box 2, thereby defining electromagnetic shielding for the connector element 1.

The position of the intermediate card 4 is optionally adjusted relative to the box 2 by causing the ends of the conductors 35 to slide in the oblong orifices 40.

Once the conductor element 1 has been put into place on the main printed circuit card, the projections 46 press against conductor tracks of the main printed circuit card so as to be soldered thereto, thereby putting the conductor tracks 55 into contact with these conductor tracks on the main card. Electrical connection between a central conductor 35 and a conductor track on the main printed circuit card is thus ensured.

The tabs 14 can be soldered to the zones 57 of the card 4.

Naturally, the invention is not limited to the embodiments described above.

The invention claimed is:

1. A coaxial electrical connector element for providing electrical connection between at least one contact element and a main printed circuit card, each contact element(s) comprising a central conductor and an outer conductor, the connector element comprising:

a support element suitable for receiving the contact element(s), and an intermediate printed circuit card carrying conductor tracks enabling the central conductor(s) to be connected electrically to conductor tracks of the main printed circuit card, said intermediate printed circuit card extending in a plane, wherein the intermediate printed circuit card has an end face facing the main printed circuit card and having at least one projecting portion, such that said end face is non-rectilinear when observed in a direction perpendicular to the intermediate printed circuit card, one of the conductor tracks of the intermediate printed circuit card extending over said projecting portion and coming into contact with a conductor track of the main printed circuit card, and wherein the at least one projecting portion extends in the plane of the intermediate printed circuit card.

2. A connector element according to claim 1, wherein the intermediate printed circuit card comprises a substrate made of glass epoxy.

3. A connector element according to claim 1, said intermediate printed circuit card having two main faces, wherein at least one conductor track extends over both main faces.

4. A connector element according to claim 1, wherein the intermediate printed circuit card is rigid.

5. A connector element according to claim 1, wherein said intermediate printed circuit card comprises orifices each enabling a central conductor of a contact element to be received, each orifice being connected to a conductor track of said intermediate card.

6. A connector element according to claim 2, wherein said orifices are oblong in section so as to enable the position of the intermediate printed circuit card to be adjusted relative to the support element.

7. A connector element according to claim 2, wherein the dimensions of the orifices are selected in such a manner that a central conductor can be inserted as a force-fit in a corresponding orifice.

8. A connector element according to claim 1, wherein the support element comprises a box having housings each serving to receive a respective contact element.

9. A connector element according to claim 8, wherein said box has a first face and a second face, the first face being for receiving the intermediate printed circuit card.

10. A connector element according to claim 9, wherein said first face has peripheral portions projecting from a main plane of said first face, the intermediate printed circuit card being suitable for coming to bear thereagainst.

11. A connector element according to claim 9, wherein said second face comprises openings enabling the contact element to be inserted in said housings.

12. A connector element according to claim 1, wherein the intermediate printed circuit card and the support element include mutually-co-operating portions in relief.

13. A connector element according to claim 12, wherein the support element includes at least one deformable tab suitable for holding the intermediate printed circuit card and for making electrical contact with a ground plane of said intermediate card.

14. A connector element according to claim 13, the support element comprising a box with a first face that is substantially square for receiving the intermediate printed circuit card, wherein the box has two deformable tabs disposed substantially in the middles of two parallel edges of said first face.

15. A connector element according to claim 13, wherein the intermediate printed circuit card has side notches leaving a space between them suitable for receiving said tabs, at least in part.

16. A connector element according to claim 1, wherein the support element is conductive, and is connected to ground.

17. A connector element according to claim 16, wherein the support element is made out of at least one of molded zinc alloy and metallized plastics material.

18. A connector element according to claim 1, wherein said end face carries a plurality of projecting portions formed by projections having end faces that are substantially coplanar.

19. A connector element according to claim 18, wherein said projections are placed regularly along said end face.

20. A connector element according to claim 8, wherein said box is generally in the form of a rectangular parallelepiped.

21. A connector element according to claim 20, wherein the box has portions in relief on one face that are suitable for bearing against the main printed circuit card in order to be soldered thereto.

22. A connector element according to claim 16, wherein the intermediate printed circuit card has two faces, a first face carrying conductor tracks and a second face having a conductive metallized surface over a major portion thereof, which surface is suitable for defining a ground plane.

23. A connector element according to claim 22, wherein said surface is coated in varnish.

24. A connector element according to claim 22, wherein the ground plane is connected to the conductive support element.

25. A connector element according to claim 12, wherein the support element is conductive and is connected to ground, and wherein the ground plane of the intermediate printed circuit card is connected to the support element via said deformable tabs.

26. A connector element according to claim 25, wherein the support element is made out of at least one of molded zinc alloy and metallized plastic material.

27. A coaxial electrical connector element for providing electrical connection between at least one contact element and a main printed circuit card, each contact element (s) comprising a central conductor and an outer conductor, the connector element comprising:

a support element suitable for receiving the contact element (s), and an intermediate printed circuit card having two opposite first and second faces, said intermediate printed circuit card comprising conductor tracks extending at least partially over the first face and enabling the central conductor (s) to be connected electrically to conductor tracks of the main printed circuit card and a conductive metallized surface extending over the second face for defining a ground plane, wherein the intermediate printed circuit card has an end face facing the main printed circuit card and having at least one projecting portion such that said end face is non-rectilinear when observed in a direction perpendicular to the intermediate printed circuit card, one of the conductor tracks of the intermediate printed circuit card extending over said projecting portion and coming into contact with a conductor track of the main printed circuit card, and wherein the conductive metallized surface does not cover completely the second face of the intermediate printed circuit card.

28. A coaxial connector according to claim 27, wherein said ground plane is connected to the support element.

29. A connector element according to claim 27, wherein at least one conductor track extends over said second face of the intermediate card.

* * * * *